US006629504B2

(12) United States Patent
Stem

(10) Patent No.: US 6,629,504 B2
(45) Date of Patent: Oct. 7, 2003

(54) CONVERTABLE TABLE WITH REVERSIBLE LEAVES

(76) Inventor: Seth Stem, 37 Liberty St., Warren, RI (US) 02885

( * ) Notice: Subject to any disclaimer, the term of this patent is extended or adjusted under 35 U.S.C. 154(b) by 0 days.

(21) Appl. No.: 10/083,951

(22) Filed: Feb. 27, 2002

(65) Prior Publication Data

US 2002/0117091 A1 Aug. 29, 2002

Related U.S. Application Data

(60) Provisional application No. 60/271,854, filed on Feb. 27, 2001.

(51) Int. Cl.[7] ..... A47F 85/00
(52) U.S. Cl. ..... 108/13; 108/69; 108/77
(58) Field of Search ..... 108/13, 15, 11, 108/77, 69, 78, 83, 89, 59, 65

(56) References Cited

U.S. PATENT DOCUMENTS 123,172 A * 1/1872 Hoese
334,977 A * 1/1886 Peace
2,603,500 A * 7/1952 Messier
2,900,667 A * 8/1959 Longenecker
3,058,793 A * 10/1962 Schultz
4,109,589 A * 8/1978 Ruckriegel et al.
4,282,817 A * 8/1981 Gutterman
6,164,211 A * 12/2000 Faris

FOREIGN PATENT DOCUMENTS

FR 2597735 * 4/1986

* cited by examiner

*Primary Examiner*—Jose V. Chen
(74) *Attorney, Agent, or Firm*—Barlow, Josephs & Holmes, Ltd.

(57) ABSTRACT

The present disclosure provides an improved convertible table construction that includes a central table base section having a central tabletop section with at least two adjacent edges to which at least one adjustable table leaf is attached. The adjustable table leaf is "L" shaped, with one leg of the "L" being a large work surface and the other leg being a smaller work surface. The "L" shaped leaf has attachment hardware along the intersection of the legs that allow the leaf to be attached to the edges of the top work surface of the table base. The hardware is uniquely configured to allow the "L" shaped leaves to be attached in two different orientations providing for a work surface that is adjustable in size.

17 Claims, 10 Drawing Sheets

CONVERTABLE TABLE WITH REVERSIBLE LEAVES

PRIORITY CLAIM TO EARLIER FILED APPLICATION

This application claims priority from earlier filed provisional patent application No. 60/271,854, filed Feb. 27, 2001.

BACKGROUND OF THE INVENTION

The present invention relates to a convertible table system having a fixed portion with adjustable leaves along at least two adjacent edges, and more particularly to a convertible table system with adjustable leaves that can be removed and replaced in a variety of orientations to customize the configuration and size of the work surface of the table.

In general, convertible tables are well known in the art. Further, these prior art convertible tables can be roughly classified into four categories. The simple drop leaf style table is exemplary of the first type. In a drop leaf table, when the leaves are inactive they hang vertically along the sides of the table and are in the way of the legs of persons seated at the table making it virtually impossible to use the sides of the table when the leaves are stored.

The second category of table is a variation of the simple drop leaf table that includes elaborate mechanisms for raising and lowering four table leaves at the same time. In this type of table, however, the raising and lowering mechanisms preclude the leaves being able to be rotated through 180° thus preventing them from resting flush against the bottom of the table. This results in the leaves protruding from the bottom of the table along the outer attachment edge, creating a potential conflict with the legs of a user. In addition, the elaborate mechanism is expensive to construct and would require significant maintenance, creating a serious disadvantage if the tables were to be used in an environment that where they were frequently operated.

A third category of table includes a complicated hinge mechanism about which the leaves are rotated. In each case, the table leaf can be rotated substantially through 180°. However, the hinging mechanism lies between the stored leaf and the bottom of the table again causing the stored leaf to protrude from the bottom of the table along its outer attachment edge. Additionally, the complexity of the hinging mechanism means that such tables are not cost effective for mass production.

Finally, the fourth category of convertible table includes a drop leaf that is pivoted on ordinary hinges and held in an elevated operative position either by a swing out leg or sliding support member which slides beyond the edge of the base of the table to support the leaf in the operative position and retracts to be substantially at or adjacent the edge in the stored configuration. When the leaf is retracted it rests against or adjacent the sliding member rather than against the bottom of the tabletop similar to the first category of hanging leaf tables.

Another type of resizable table not included in the categories noted above is the type that includes completely removable leaves. In this type of table, typically the type seen in most dining room table sets, the table leaves that allow expansion of the table surface are placed in the middle of the table. When the leaves are not in use, they must be stored in an alternate location to prevent damage. This requirement for storage can be particularly problematic when the table is employed in an apartment type environment where storage space is already at a premium.

SUMMARY OF THE INVENTION

In this regard, the instant invention provides an improved convertible table construction that includes a central table base section having a central tabletop section with at least two adjacent edges and at least two adjustable leaves as will be further described below. For the purposes of this specification the expression "table" and "convertible table" is intended to include not only "tables" as that expression is normally and customarily understood but also office furniture such as desks, computer work stations, kitchen benches and movable trolleys and shelving units and any other similar construction where it is desirable to have optional extensions of adjacent sides of the operative working surfaces.

Accordingly, the present invention may be said broadly to include a convertible table (as herein defined) that has a base with a fixed top work surface that further includes at least one pair of adjacent edges, to which the operable leaves are attached. The leaves are unique in configuration in that when viewed from the end they are "L" shaped with one leg of the "L" being a large work surface and the other leg being a smaller work surface. The "L" shaped leaves have attachment hardware along the intersection of the legs that allow the leaves to be attached to the edges of the top work surface of the table base.

The hardware of the present invention is uniquely configured to allow the "L" shaped leaves to be attached in two different orientations. The first configuration allows the large portion of the "L" shaped leaves to be attached in an operable position whereby they are planar with the top work surface of the table base and the second leg of the "L" depends downwardly therefrom in a storage position along the legs of the support base. The second configuration is reversed from the first where the smaller portion of the leaves is in operable position and the larger leaves are in the downward storage position. Further, the leaves of the table of the present invention can be configured independently of one another where one leaf is mounted with the large work surface in operable position and the second leaf is mounted with the small work surface in the operable position. It should also be understood that this configuration can be reversed as described above.

Accordingly, it is an object of this invention to overcome the disadvantages of the previously described convertible tables through the provision of a novel customizable table leaf system. It is a further object of the present invention to provide a convertible table device that employs a leaf system that allows the table work surface to have an adjustable size while also providing integral storage for the inactive table leaf. It is yet another object of the present invention to produce a convertible table system that allows the user to customize the size of the work surface in a simple manner that also provides for integral storage of the inactive leaf in a manner that does not interfere with the user of the table while also eliminating the need for separate storage provisions.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
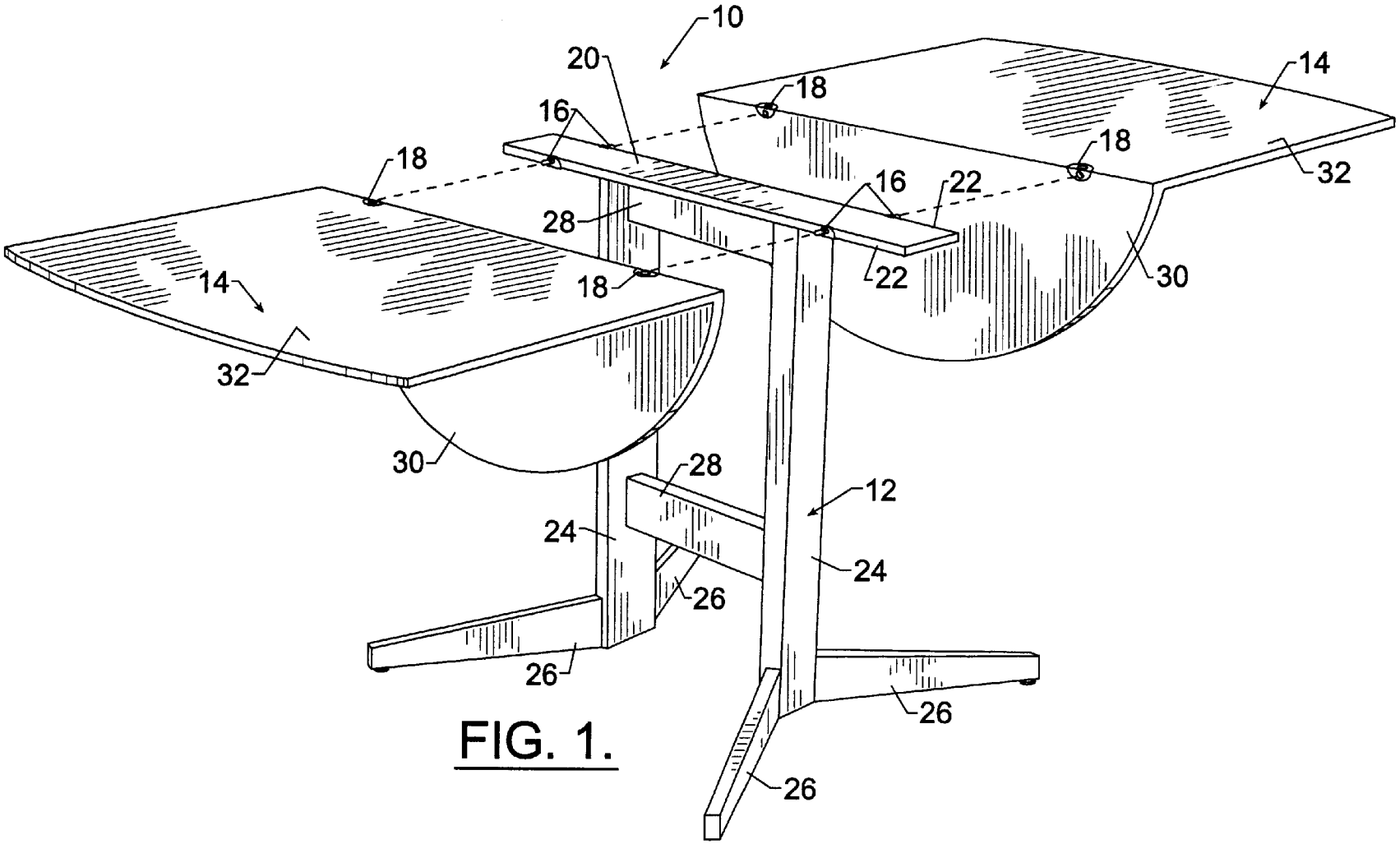
FIG. 1 is an exploded perspective view of the convertible table of the present invention.

Referring now to the drawings, the convertible table of the present invention is illustrated and generally indicated at 10 in FIGS. 1–8. As will hereinafter be more fully described, the instant invention utilizes a novel configuration of work surfaces to create a convertible table that has a customizable work surface and provides for self-storage of the inactive leaves.

Turning to FIG. 1, the convertible table comprises a central support section generally indicated at 12, at least one "L" shaped leaf component generally indicated at 14, a mounting pin component 16 and a mounting receiver component 18. The leaves 14 are generally "L" shaped and can be used singularly or in multiples under the disclosure of the present invention.

In the preferred embodiment of the present invention, the central support section 12 is provided as a table support. The table support 12 has a top work surface 20 that is generally rectangular with two parallel edges 22. The top work surface 20 is supported on two vertical leg elements 24 that extend downwardly therefrom. The legs 24 are of sufficient length to support the top work surface 20 a the optimum distance from the floor to allow the table 10 of the present invention to be used as a table for dining or other activities where the user would typically be seated. The height of the legs 24 however can be tailored however to accommodate the anticipated end use of the table 10, for example if the user would typically use the table 10 while standing, the legs 24 would be made longer. The vertical legs 24 are further provided with protruding arms 26 at their bottom. These arms 26 extend outwardly from the bottom end of the vertical leg elements 24 and provide increased contact with the support surface upon which the table 10 is placed to increase the overall stability of the table 10 and prevent it from overturning or from becoming generally unstable during use. Further, horizontal support members 28 extend between the vertical leg elements 24 to maintain the relative spacing between the vertical leg elements 24 adding additional rigidity to the overall central support element 12. At least one horizontal support member 28 is provided at the top of the leg elements 24 adjacent to the bottom of the top work surface 20. Additional horizontal members 28 may be added further down the length of the vertical leg elements 24 if indicated by the structural requirements of the table 10 or to produce a certain look or feel to the table 10.

Although a detailed description is provided above relative to the central support section 12 of the table 10 of the present invention, the disclosure of the present invention can also be used in connection with alternate vertical support elements. Any substantially vertical surface can be employed with the present invention to provide support to the table leaf elements 14. For example, a vertical wall surface or a vertical railing assembly such as provided around a balcony can be used as an attachment surface for the mounting pin hardware 16 of the present invention and can receive a leaf element 14 as will be further described below. Therefore, the present invention provides a versatile and customizable working surface that can be employed in a variety of configurations and with a variety of supporting means.

The leaf element 14 of the present invention is generally "L" shaped when viewed from one end. The leaf 14 includes two work surfaces 30, 32 that are disposed substantially perpendicular to one another and are connected to one another along one common edge. The present invention provides for the attachment of the leaf element 14 to the central support 12 using the hardware components 16, 18 as will be described below so that one of the two work surfaces 30, 32 is planar with the top work surface 20 of the central support section 12 and adjacent to one or its parallel edges 22, while the other work surface 30, 32 extends downwardly along the side of the vertical leg element 24. It can be understood that if the central support 12 provided is a wall or railing as described above, the active work surface will extend horizontally outward from the wall or rail while the inactive work surface will extend downwardly along the wall.

Figure 2:
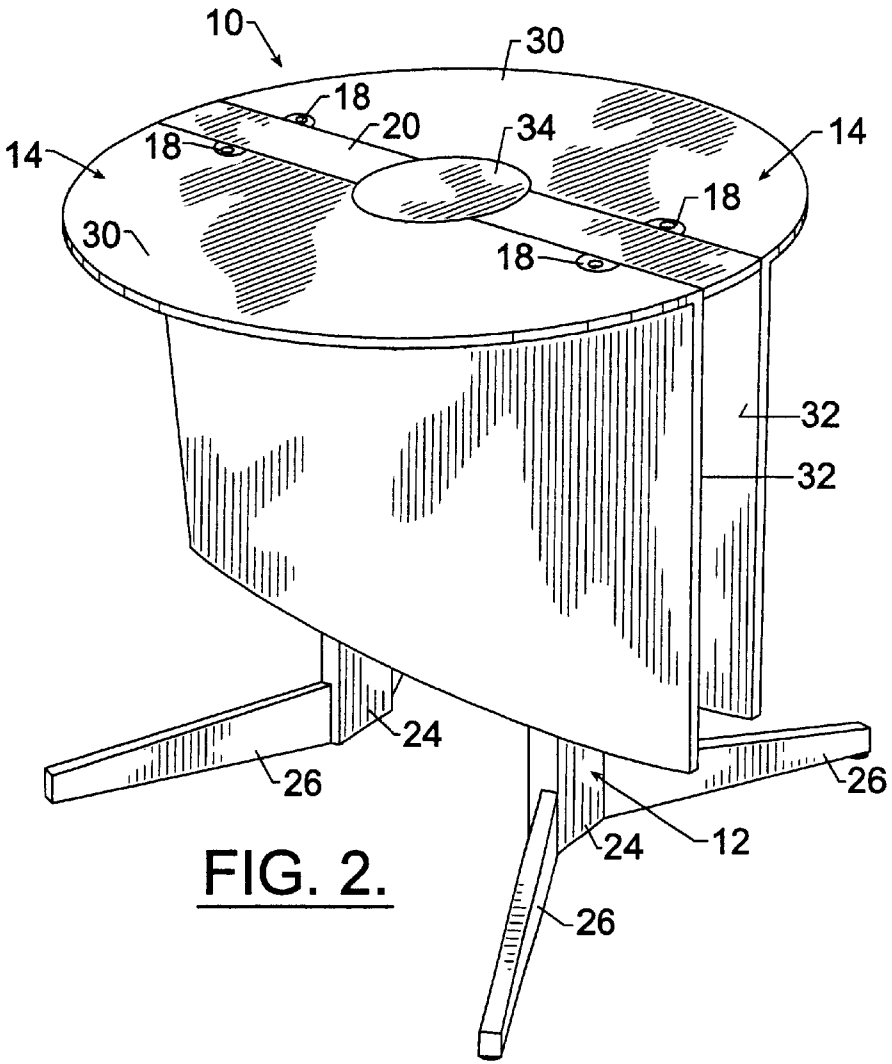
FIG. 2 is an assembled perspective view thereof with the leaves in the small work surface configuration.
Figure 3:
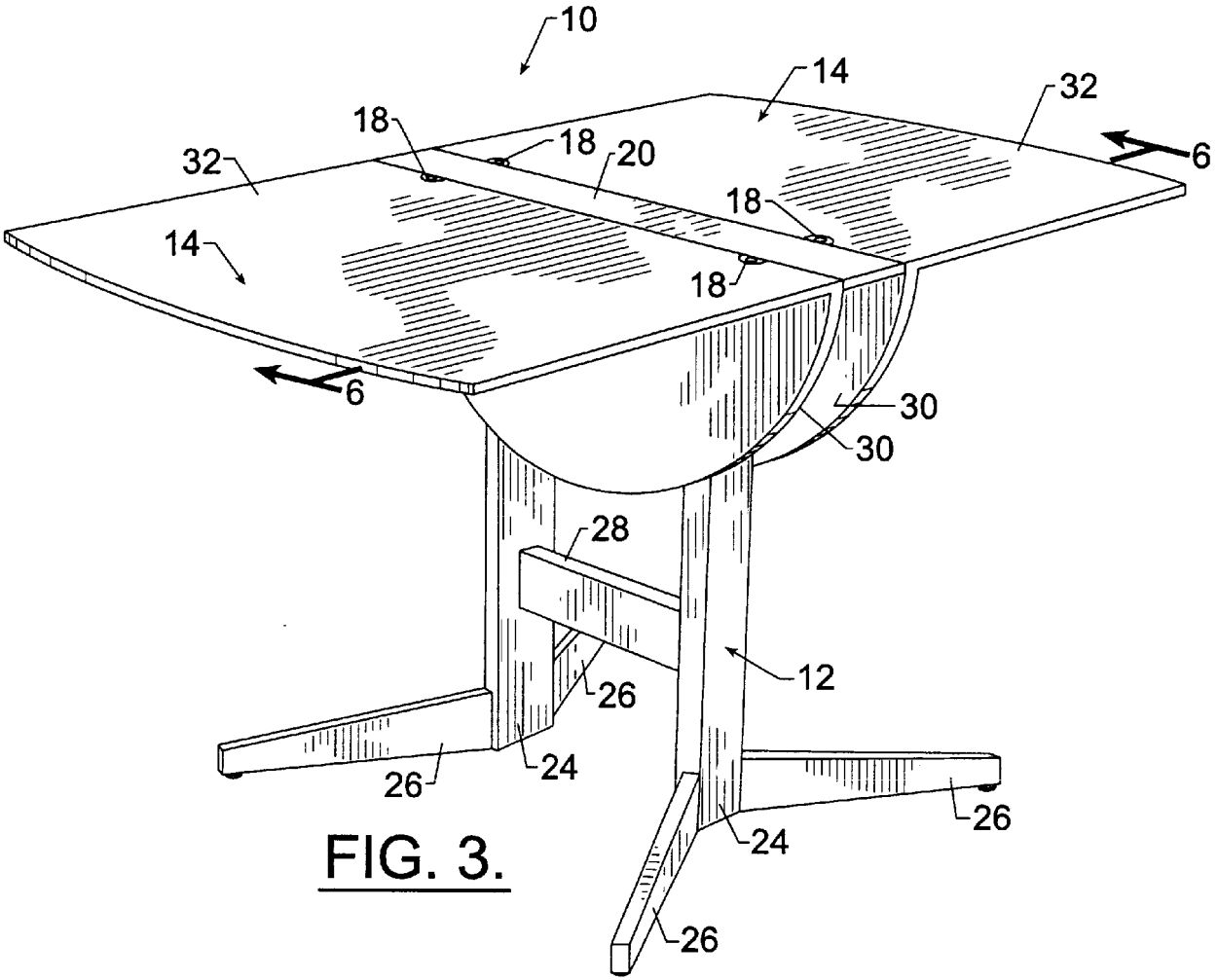
FIG. 3 is an assembled perspective view thereof with the leaves in the large work surface configuration.
Figure 4:
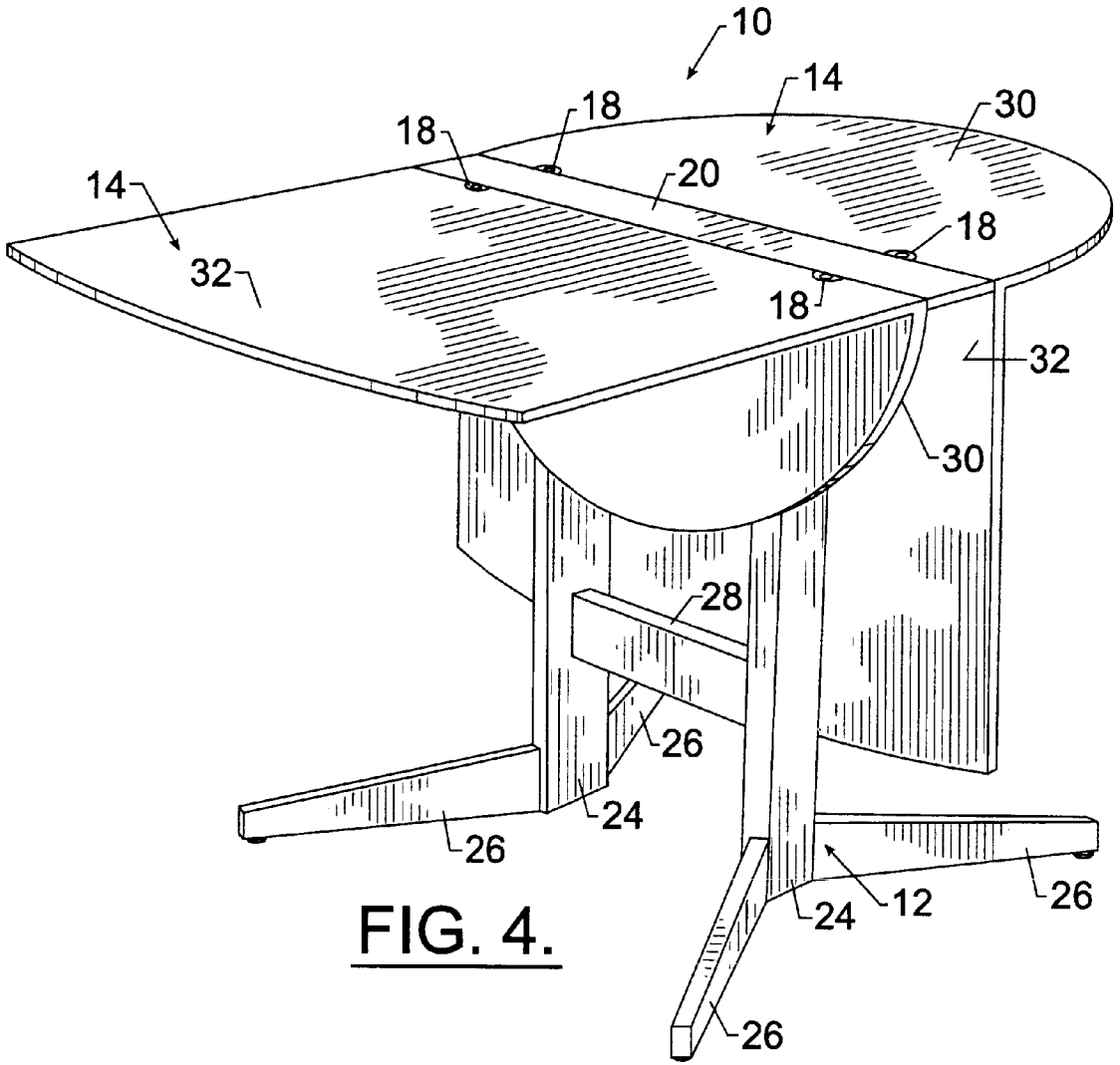
FIG. 4 is an assembled perspective view thereof with one leaf in the small work surface configuration and one leaf in the large work surface configuration.

In order to provide a working surface that is flexible with respect to size, the two working surfaces 30, 32 of the leaf element have two different sizes and shapes. Turning to FIGS. 2, 3 and 4, the table of the present invention is shown with a pair of leaf elements 14 installed in a variety of configurations. As can be seen, the leaf elements 14 are provided with one work surface 32 that is larger and is substantially rectangular while the second work surface 30 is smaller and substantially a half-circle in shape. The mounting hardware components 16, 18, as will be discussed further below, allow each of the leaf elements 14 to be installed in two different orientations, providing for either the larger 32 or smaller 30 work surface to be installed in operative position, planar with the top working surface 20 of the central support 12. The leaf elements 14 further can be installed in either orientation independent of the orientation of the other leaf elements 14 used. For example, FIG. 2 shows the table 10 assembled with the smaller work surfaces 30 of both leaves 14 in the operative, active position. FIG. 3 shows the table 10 assembled with the larger work surfaces 32 of both leaves in the active position. Finally, FIG. 4 shows the table 10 assembled with the smaller work surface 30 of one leaf 14 and the larger work surface 32 of the other leaf 14 in the active position. As can be seen the present invention provides the user with a great deal of flexibility in adjusting the size of the work surface of the table 10 to accommodate his/her present needs. In addition, while the sizes and shapes shown for the two work surfaces 30, 32 of the leaf elements 14 include a smaller semi-circle and a larger rectangle, they are shown in this manner for illustration only and are not meant to be a limitation on the present invention. For example, triangles, polygons, or other curved shapes could easily be substituted for the working surfaces 30, 32 of the present invention and still fall within the scope of the present disclosure.

Figure 5:
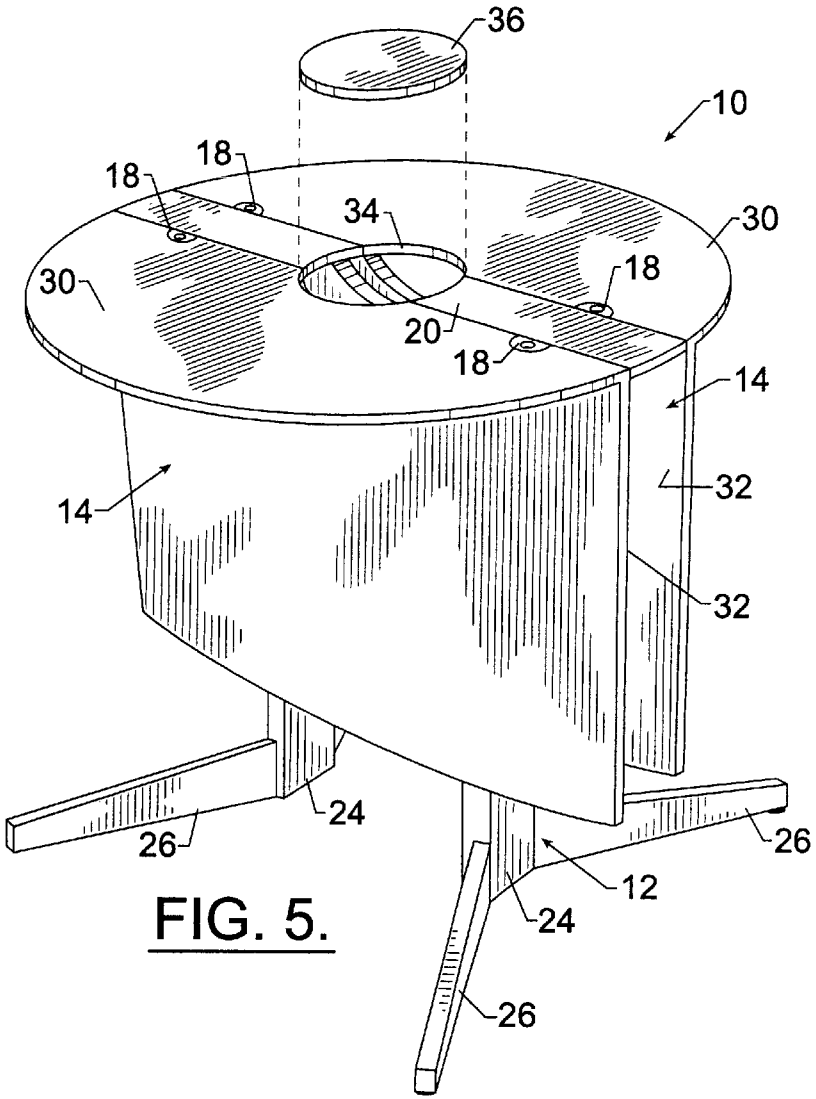
FIG. 5 is a perspective view thereof with an optional center receptacle cover removed.

Turning to FIG. 5 a cutout 34 is shown provided in the center of the top support surface 20 and in the leaf components 14. The cutout 34 is shown as being circular and is provided to allow the user of the table to place a bowl or vase securely at the center of the table 10 to contain for example, flowers or fruit. Further, the cutout opening 34 can be used as a hand hold while lifting the "L" shaped leaf elements 14. A cover 36 is provided to place over the cutout 34 opening when the cutout 34 is not in use, thereby providing a smooth flat work surface.

Figure 6:
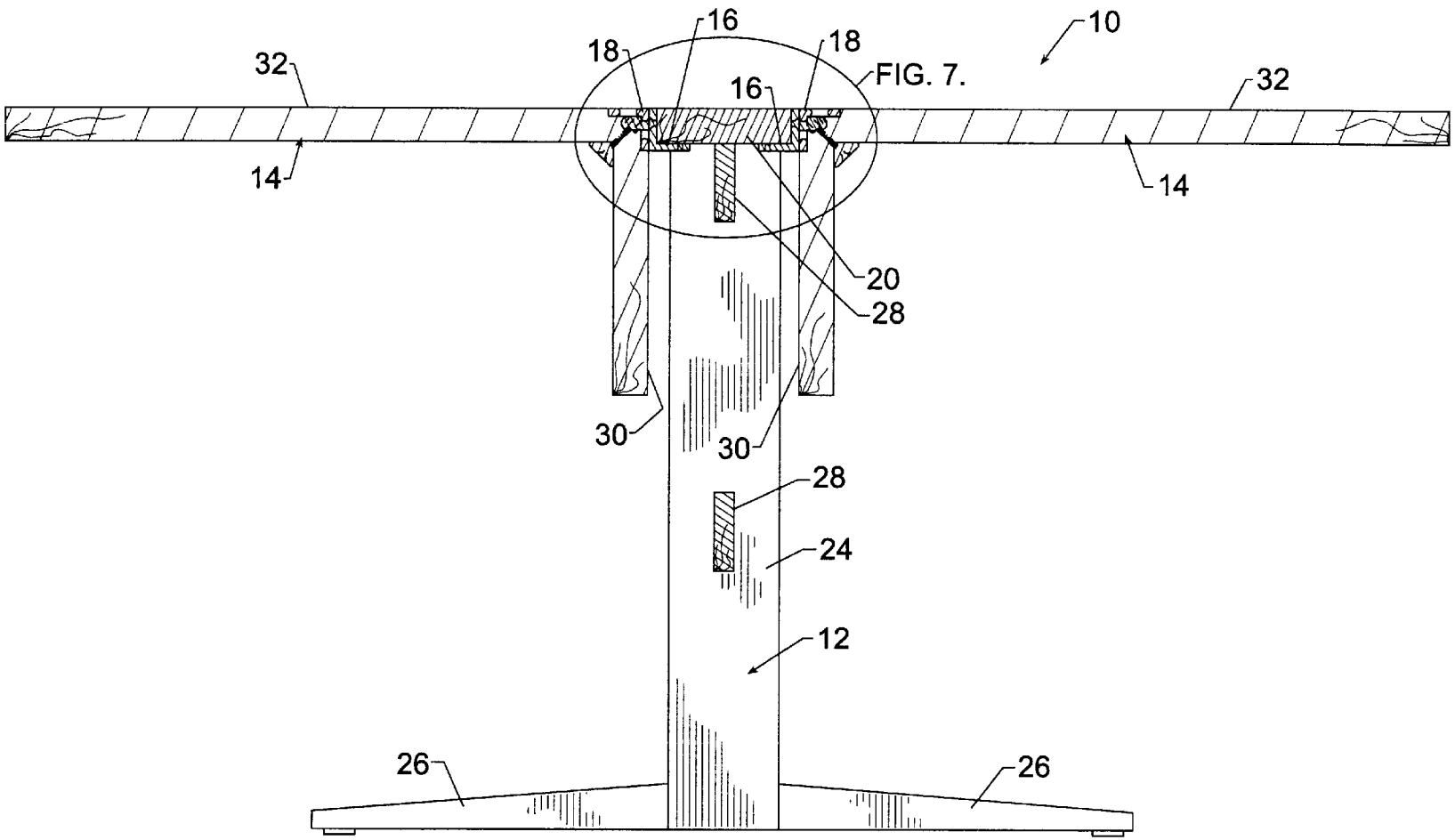
FIG. 6 is a cross-sectional view thereof as taken along line 6—6 of FIG. 3.
Figure 7:
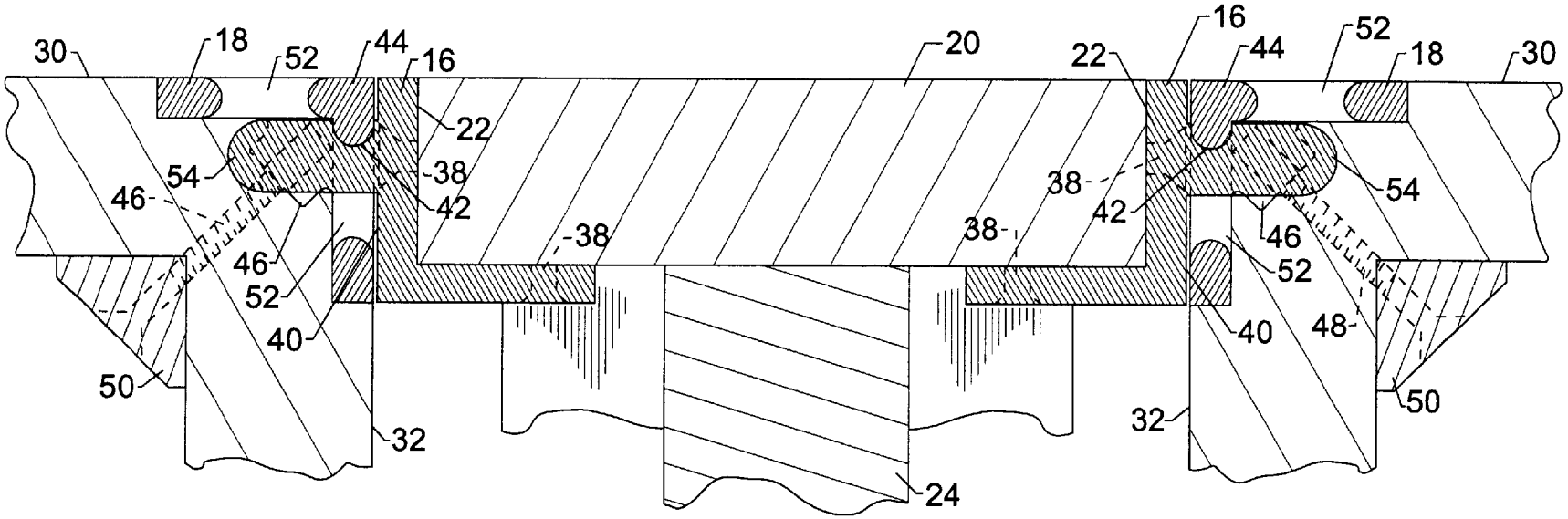
FIG. 7 a detailed cross sectional view of the mounting hardware thereof.
Figure 8:
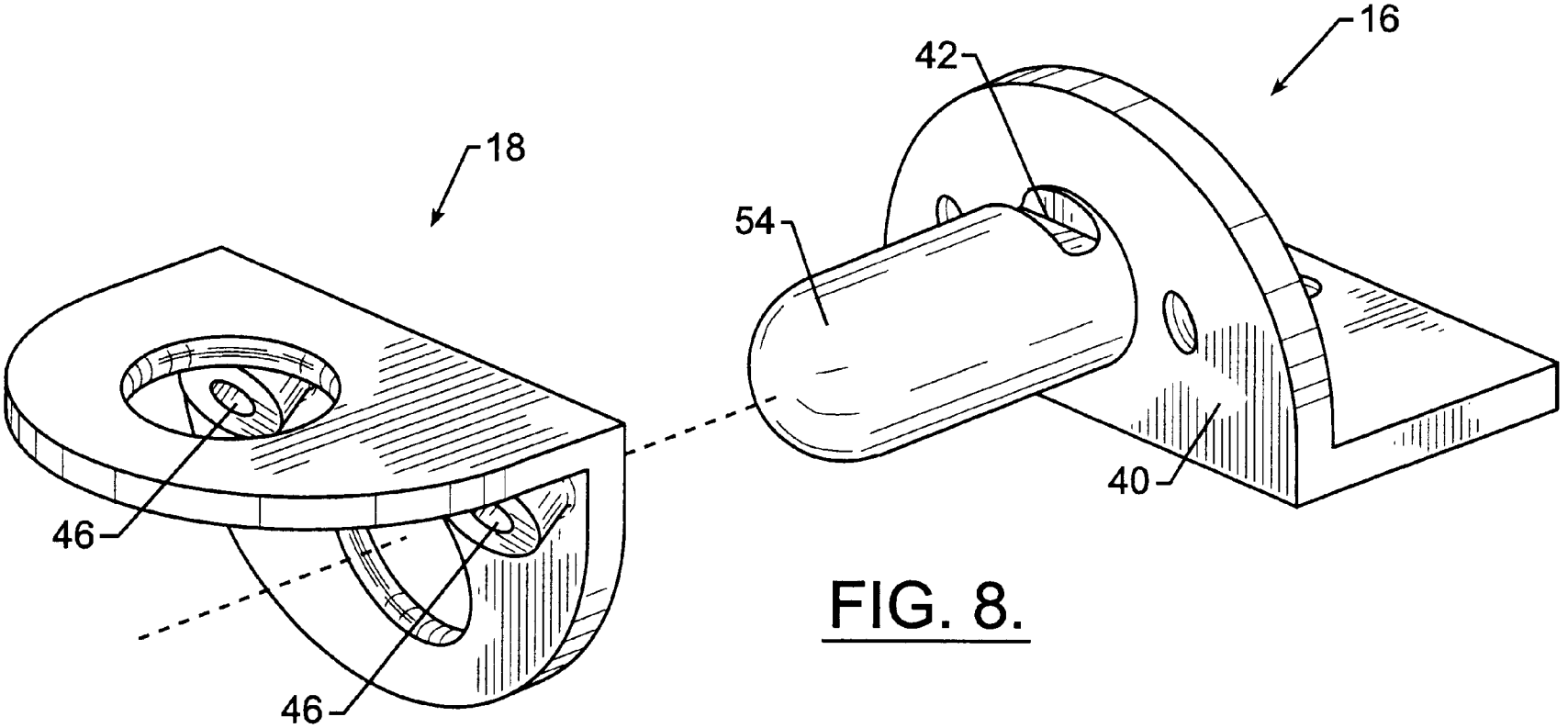
FIG. 8 is a perspective view of the mounting hardware thereof.

Turning to FIGS. 6, 7 and 8 the mounting hardware 16, 18 of the present invention 10 is shown. In FIGS. 6 and 7 a sectional view of the hardware components 16, 18 is shown with them installed on the central support 20 and leaf elements 14. One of the hardware components is a mounting pin 16 that is attached to the central support 20 using fasteners 38 such as screws. The mounting pin 16 is attached to the edge of the central support surface 20 so that its front face 40 is flush with the parallel edges 22 of the top work surface 20. This is accomplished typically by mortising the edge 22 of the central support 12 before installing the mounting pin 16. By installing the mounting pin 26 flush with the edge 22 of the top surface 20, the leaf components 14 can be installed, as will be further described below, without producing a gap between the top support surface 20 and the active work surface 30, 32 of the leaf component 14. Also, as was described above, the mounting pin 16 can be installed on other vertical surfaces where the use of a table leaf 14 is desired, such as along a wall or balcony rail. In these cases, the mounting pin 16 can be attached using any type of hardware as is well known in the art.

The mounting pin 16 includes a groove 42 in its top surface to receive a retaining lip 44 that is provided in the receptor hardware 18. The receptor hardware 18 is attached to the leaf component 14 of the present invention 10. The receptor hardware 18 is essentially "L" shaped with a face residing in the same plane of each of the two work surfaces 30, 32 of the leaf component 14 and is installed along the common edge of the two work surfaces 30, 32 of the leaf components 14. The receptor hardware 18 is mounted flush with the plane of the work surfaces 30, 32 in the same manner as was described above relative to the mounting pin hardware 16. Threaded screw holes 46 are integrally formed on the back of the receptor hardware 18 to receive machine screws 48 that are inserted through the back of the leaf components 14 to hold the receptor hardware 18 in place on the leaf component 14. Additionally, a reinforcing block 50 may be provided at the back of the leaf component 14 to further strengthen the connection between the receptor hardware 18, the machine screw 48 and the leaf component 14. The receptor hardware 18 has two holes 52 provided in the two surfaces thereof. The holes 52 are placed symmetrically on each surface of the receptor hardware 18 and are located at the same distance from the common edge of the two work surfaces 30, 32 thereby facilitating the alignment of the work surfaces 30, 32 with the top support surface 20. The holes 52 are slightly larger than the diameter of the pins 54 on the mounting pin hardware 16 to allow the receptor hardware 18 and mounting pin 54 to smoothly engage and disengage. The holes 52 are located in the receptor hardware 18 so that a ridge 44 is formed along the top edge of the hole 52 that engages in the groove 42 in the mounting pin 54 to firmly retain the leaf components 14 in an active position against the mounting surface 20. As can be seen in FIG. 7 the hardware is configured to maintain the top surface 20 of the central support 12 and the active work surface 30, 32 in a planar relationship when the hardware 16, 18 is engaged. Finally, since holes 52 are provided in both planes 30,32 of the leaf components 14, it is clear that the leaf component 14 can be mounted allowing either work surface 30, 32 to be in the horizontal, active position.

Figure 9:
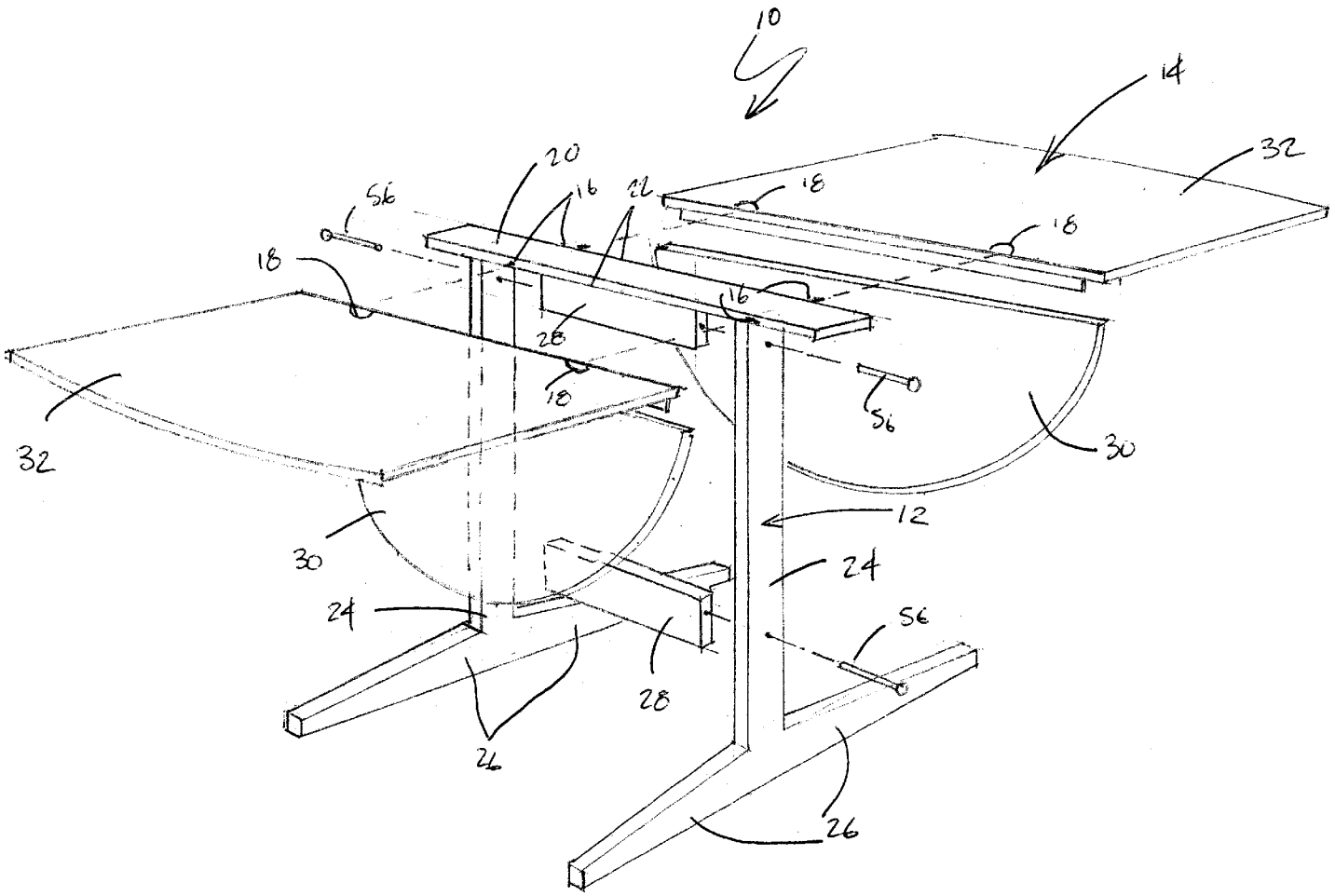
FIG. 9 is an exploded perspective view of an alternate embodiment of the present invention.
Figure 10:
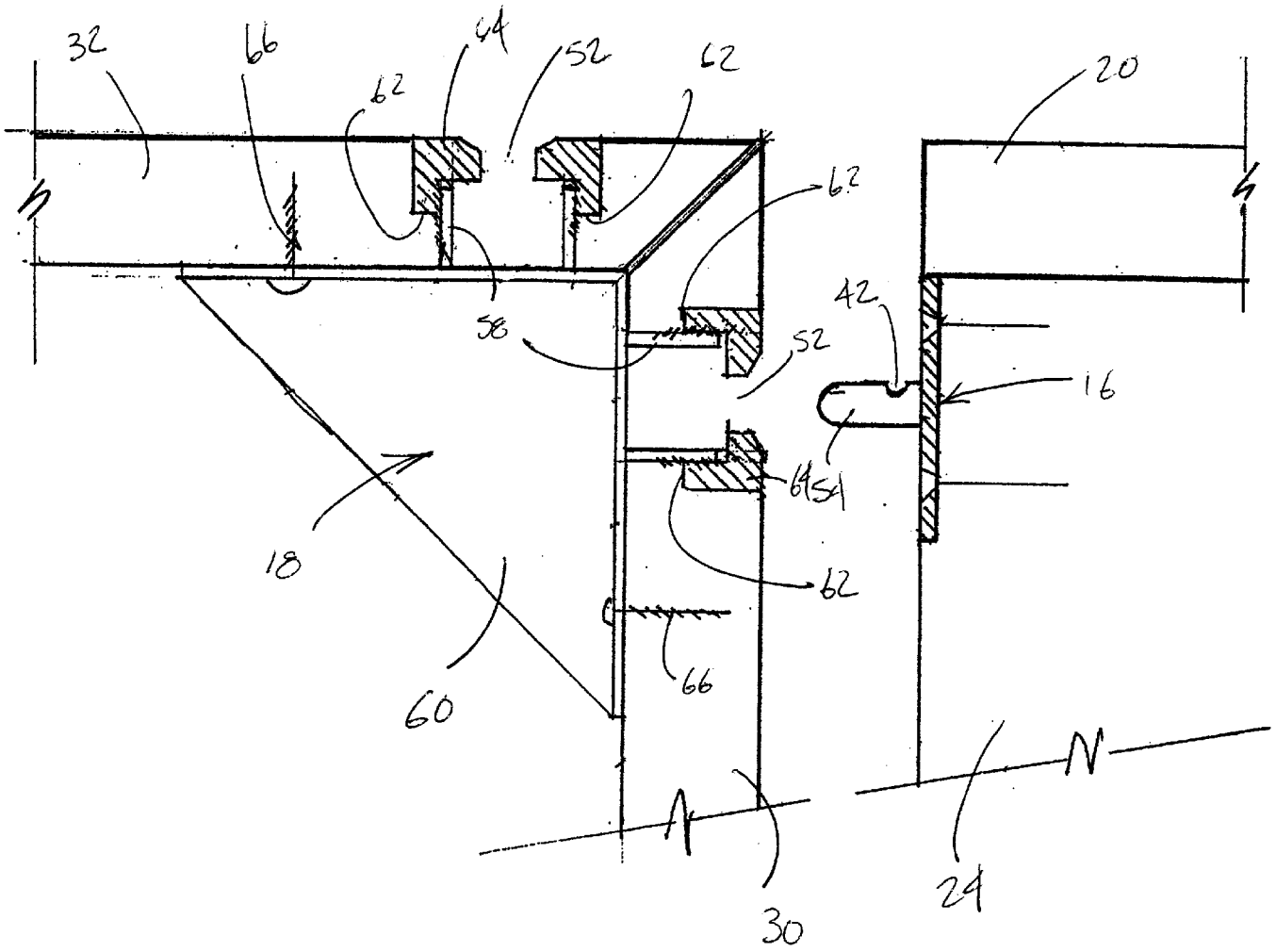
FIG. 10 is a cross sectional view of the mounting hardware thereof.

To facilitate manufacturing and shipping the convertible table 10 the present invention may be constructed as shown in FIGS. 9 and 10. All of the components of the table 10 are the same as previously described with a few exceptions. First, leg extensions 26 are provided in the same plane as the vertical leg elements 24 so that the assembly is flat and can be manufactured as one integral piece. Further, the vertical leg elements 24, horizontal reinforcing members 28 and top surface 20 are all flat pieces that are shipped unassembled. In addition, fasteners 56 are provided for use in assembling the table components and to hold the table 10 in the assembled configuration. The leaf elements 14 are also fabricated so that each of the perpendicular work surfaces 30 and 32 can be shipped separately in a flat manner. The common edge where the work surfaces 30 and 32 meet is mitered at a 45° bevel to allow the two work surfaces 30 and 32 to meet and form a smooth corner joint. The receptor hardware 18 is revised to facilitate the assembly of the leaf component 14. The receptor hardware 18 has two cups 58 integrally formed with an angle bracket 60. The cups 58 have male threads on their outer surface. The work surfaces 30 and 32 have holes bored into them corresponding the installation location of the receptor hardware 18. In addition, the hole is bored to have a raised shoulder 62 that is larger than the outer diameter of the cups 58. The cap 64 portion of the receptor hardware 18 is inserted into the hole in the work surfaces 30 and 32 and has female threads that engage the matching threads on the outer surface of the cup 58. The cap 64 is threaded onto the cup 58 and tightened until it firmly retains the work surfaces 30 and 32 in place by contacting the shoulder 62. Further, screws 66 can be installed to further strengthen the connection between work surfaces 30 and 32.

It can therefore be seen that the instant invention provides a convenient, customizable table 10 having a reconfigurable work surface. The table 10 can be constructed for low cost and provides the user with a table 10 that has a resizable work surface that is easily operated. Further, it can be seen that the present invention has application beyond the scope of a table to provide expandable workspace throughout a room by allowing the addition of leaf components along walls or railings. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A modular work surface assembly comprising:

a central support having a top surface wherein said top surface has at least one linear side edge;

at least one L-shaped leaf having first and second perpendicular work surfaces joined along a common edge; and at least one fastener component, said fastener component having a first and second mating parts, said first part being mounted to said linear edge of said central support and said second part being mounted to said common edge of said L-shaped leaf, said first and second parts being configured to cooperate to selectively mount said leaf on said central support, said leaf component being selectively mounted to said central support section in a first position wherein said first work surface is perpendicular to top surface of said central support section, and said second work surface is planar with said top surface of said central support section, said leaf component being selectively mounted to said central support section in a second position wherein said second work surface is perpendicular to top surface of said central support section, and said first work surface is planar with said top surface of said central support section.

2. The modular work surface assembly of claim 1, wherein said first and second work surfaces have different shapes.

3. The modular work surface assembly of claim 1, wherein said first and second work surfaces are releasably joined along said common edge.

4. The modular work surface assembly of claim 2, first work surface is shaped substantially as a half circle and said second work surface is shaped substantially as a rectangle.

5. The modular work surface assembly of claim 1, wherein said top surface has two parallel linear side edges and said at least one leaf component further comprises:

a first and second leaf component, wherein said first leaf component is selectablely attachable adjacent to said first edge of said top surface and said second leaf component is selectablely attachable adjacent to said second edge of said top surface.

6. The modular work surface assembly of claim 1, wherein said fastener component comprises;

said first part consisting of at least one mounting pin mounted to said first edge of said top surface of said center support; and said second part consisting of at least one mounting receptor having at least one opening therein, said mounting receptor being mounted to said common edge of said leaf component, wherein said mounting pin is received and selectively retained in said opening in said mounting receptor.

7. The modular work surface assembly of claim 1, wherein said fastener component comprises:

first and second fastener assemblies, each of said fastener assemblies further comprising at a first part consisting of a mounting pin mounted to said edge of said top surface of said center support, and a second part consisting of a mounting receptor having at least one opening therein, said mounting receptor being mounted to said common edge of said leaf component, wherein said mounting pin is received and selectively retained in said opening in said mounting receptor.

8. The modular work surface assembly of claim 6, wherein said mounting pin has a groove therein and said receptor hardware has two receptor holes, each having an edge, wherein said first receptor hole is disposed in the plane of said first work surface and said second receptor hole is disposed in the plane of said second work surface, wherein said edge of said mounting hole engages said groove in said mounting pin.

9. A convertible table assembly comprising:

a central support section, said support section having a support member and a top surface mounted thereto, wherein said top surface has first and second parallel edges and at least one first mounting member attached to each of said first and second parallel edges; and two convertible leaf components, each having first and second work surfaces having peripheral edges, said first and second work surfaces being joined along a common edge, said first and second work surface being substantially perpendicular to one another and at least one second mounting member attached to each of said leaf components at said common edges; wherein said leaf components are selectablely attachable to said central support section using said first and second mounting members, wherein said common edge of said work surfaces of said first leaf component is adjacent to said first edge of said central support section with said first or second work surface being planar with said top surface of said central support and said common edge of said work surfaces of said second leaf component is adjacent to said first edge of said central support section with said first or second work surface being planar with said top surface of said central support.

10. The convertible table assembly of claim 9, further comprising:

said first mounting member consisting of at least one mounting pin mounted to said first edge of said top surface of said center support; and said second mounting member consisting of at least one mounting receptor having at least one opening therein, said mounting receptor being mounted to said common edge of said leaf component, wherein said mounting pin is received and selectively retained in said opening in said mounting receptor.

11. The modular work surface assembly of claim 10, wherein said mounting pin has a groove therein and said receptor hardware has two receptor holes, each having an edge, wherein said first receptor hole is disposed in the plane of said first work surface and said second receptor hole is disposed in the plane of said second work surface, wherein said edge of said mounting hole engages said groove in said mounting pin.

12. A modular work surface assembly comprising:

a substantially planar vertical support;

at least one leaf component having first and second work surfaces, said first and second work surfaces being joined along a common edge, said first and second work surface being substantially perpendicular to one another; and at least one fastener component, said fastener component having first and second mating parts, said first part being mounted to said vertical support and said second part being mounted to said common edge of said leaf component, said first and second parts being configured to cooperate to selectively mount said leaf on said vertical support;

said leaf component being selectably attachable to said vertical support surface wherein said common edge of said work surfaces is adjacent to said plane of said vertical support surface with said first or second work surface being perpendicular to said plane of said vertical support surface.

13. The modular work surface assembly of claim 12, wherein said first and second work surfaces have different shapes.

14. The modular work surface assembly of claim 12, wherein said first and second work surfaces are releasably joined and can be separated into separate components.

15. The modular work surface assembly of claim 13, wherein said first work surface is shaped substantially as a half circle and said second work surface is shaped substantially as a rectangle.

16. The modular work surface assembly of claim 12, further comprising:

said first part consisting of at least one mounting pin mounted to said vertical support surface; and said second part consisting of at least one mounting receptor having at least one opening therein, said mounting receptor being mounted to said common edge of said leaf component, wherein said mounting pin is received and selectively retained in said opening in said mounting receptor.

17. The modular work surface assembly of claim 16, wherein said mounting pin has a groove therein and said receptor hardware has two receptor holes, each having an edge, wherein said first receptor hole is disposed in the plane of said first work surface and said second receptor hole is disposed in the plane of said second work surface, wherein said edge of said mounting hole engages said groove in said mounting pin.

* * * * *